US006286302B1

(12) United States Patent
Farmer et al.

(10) Patent No.: US 6,286,302 B1
(45) Date of Patent: Sep. 11, 2001

(54) VENTURI FOR USE IN THE SWIRL CUP PACKAGE OF A GAS TURBINE COMBUSTOR HAVING WATER INJECTED THEREIN

(75) Inventors: Gilbert Farmer, Cincinnati, OH (US); James A. Groeschen, Hebron, KY (US); Mark G. Rettig, Cincinnati, OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/283,428

(22) Filed: Apr. 1, 1999

(51) Int. Cl.[7] ..... F02C 7/00
(52) U.S. Cl. ..... 60/39.55; 60/748
(58) Field of Search ..... 60/748, 743, 39.55, 60/39.32

(56) References Cited

U.S. PATENT DOCUMENTS 4,199,934 * 4/1980 Meyer ..... 60/39.23
4,222,230 * 9/1980 Bobo et al. ..... 60/39.36
4,455,839 * 6/1984 Wuchter ..... 60/737
5,220,786 * 6/1993 Campbell ..... 60/39.32
5,375,420 * 12/1994 Falls et al. ..... 60/747
6,021,635 * 2/2000 Gaag ..... 60/39.05
6,047,539 * 4/2000 Farmer ..... 60/39.02

* cited by examiner

*Primary Examiner*—Timothy S. Thorpe
*Assistant Examiner*—Ehud Gartenberg
(74) *Attorney, Agent, or Firm*—Andrew C. Hess; William Scott Andes

(57) ABSTRACT

A combustion apparatus for a gas turbine engine including a combustor structure having at least one combustion chamber, a dual cone fuel nozzle for injecting both fuel and water to the combustion chamber, and a swirl cup package upstream of and adjacent to the combustion chamber. The swirl cup package further includes a swirler and a venturi extending between the nozzle and the combustion chamber for mixing the fuel and water with air. The venturi is configured to have a non-uniform thickness from an upstream end to a downstream end resulting in a cross-sectional area which provides a heat transfer conduction path that reduces axial stresses imposed on the venturi when water impinges on an upstream portion of the venturi.

17 Claims, 3 Drawing Sheets

VENTURI FOR USE IN THE SWIRL CUP PACKAGE OF A GAS TURBINE COMBUSTOR HAVING WATER INJECTED THEREIN

BACKGROUND OF THE INVENTION

The present invention relates generally to a combustor for a gas turbine engine having water injection for NOx abatement and, in particular, to a venturi in the swirl cup package for such combustor which is configured to have a thickness from an upstream end to a downstream end that provides a heat transfer conduction path and reduces axial stresses imposed thereon.

It is well known that the combustor of a gas turbine engine is subjected to extreme temperatures during operation, perhaps as high as 3500° F. Accordingly, several measures have been employed in the art to protect combustor components against thermal shock and high thermal stresses. These include the use of new and exotic metal alloys, various heat shield configurations, cooling schemes and certain types of thermal barrier coatings as demonstrated by U.S. Pat. No. 5,553,455 to Craig et al., U.S. Pat. No. 5,528,904 to Jones et al., U.S. Pat. No. 5,220,786 to Campbell, U.S. Pat. No. 4,655,044 to Dierberger et al., and U.S. Pat. No. 4,567,730 to Scott.

Another consideration involved with the design of gas turbine combustors is the ability to minimize emissions therefrom. In the case of marine and industrial applications, this has typically been accomplished through the injection of water into the combustor to reduce the temperature therein (e.g., through the nozzle circuit utilized for supplying fuel). It has been found, however, that such water injection has had the undesirable effect of causing metal distress and erosion to certain components of the combustor due to cavitation and impingement. The particular combustor components concerned may vary depending upon combustor design and exactly where impingement of the water takes place. It will be understood, however, that water is more punitive than other fluids passing through the combustor, such as liquid fuel and steam, because it has a higher coefficient of convective heat transfer and, all else being equal, causes higher thermal stress.

While some attempts have been made to solve both the thermal and erosion problems set forth above, such as in the Campbell patent, it will be noted that the venturi therein has an "extended" design, meaning it has an axial length from an upstream end adjacent the swirler to a downstream end adjacent the downstream end of the swirl cup spaced radially about the venturi. While this extended venturi design helps minimize water erosion of the dome components by releasing the water further downstream, it has been found that the fuel exiting the venturi with the water is so close to the igniter location as to make light-off for liquid fuel very difficult. Moreover, it will be appreciated that the three-piece welded assembly of the swirler, venturi and heat shield in the '786 patent is more expensive than desired.

It will also be recognized in a previously filed application by the assignee of the present invention, entitled "Method Of Protecting Gas Turbine Combustor Components Against Water Erosion And Hot Corrosion," Serial No. 09/070,053, that a swirl cup package is disclosed in which a dense vertically cracked thermal barrier coating is applied to selected portions thereof subjected to water impingement. A short, thick venturi is depicted therein which has such thermal barrier coating located at a downstream portion thereof since the cone emanating from the fuel nozzle strikes this area for that particular application.

Thus, in light of the foregoing, it would be desirable for an improved venturi design to be developed which protects against axial stresses imposed thereon stemming from thermal gradients created by water injection into the combustor. It would also be desirable to minimize the number of components forming the swirl cup package, as well as reduce the cost of manufacturing it.

BRIEF SUMMARY OF THE INVENTION

In an exemplary embodiment of the invention, a combustion apparatus for a gas turbine engine is disclosed as including a combustor structure having at least one combustion chamber, a dual cone fuel nozzle for injecting both fuel and water to the combustion chamber, and a swirl cup package upstream of and adjacent to the combustion chamber. The swirl cup package further includes a swirler and a venturi extending axially between the fuel nozzle and the combustion chamber for mixing the fuel and water with air. The venturi is configured to have a thickness from an upstream end to a downstream end which provides a heat transfer conduction path that reduces axial stresses imposed on the venturi by thermal gradients.

DETAILED DESCRIPTION OF THE INVENTION

Figure 1:
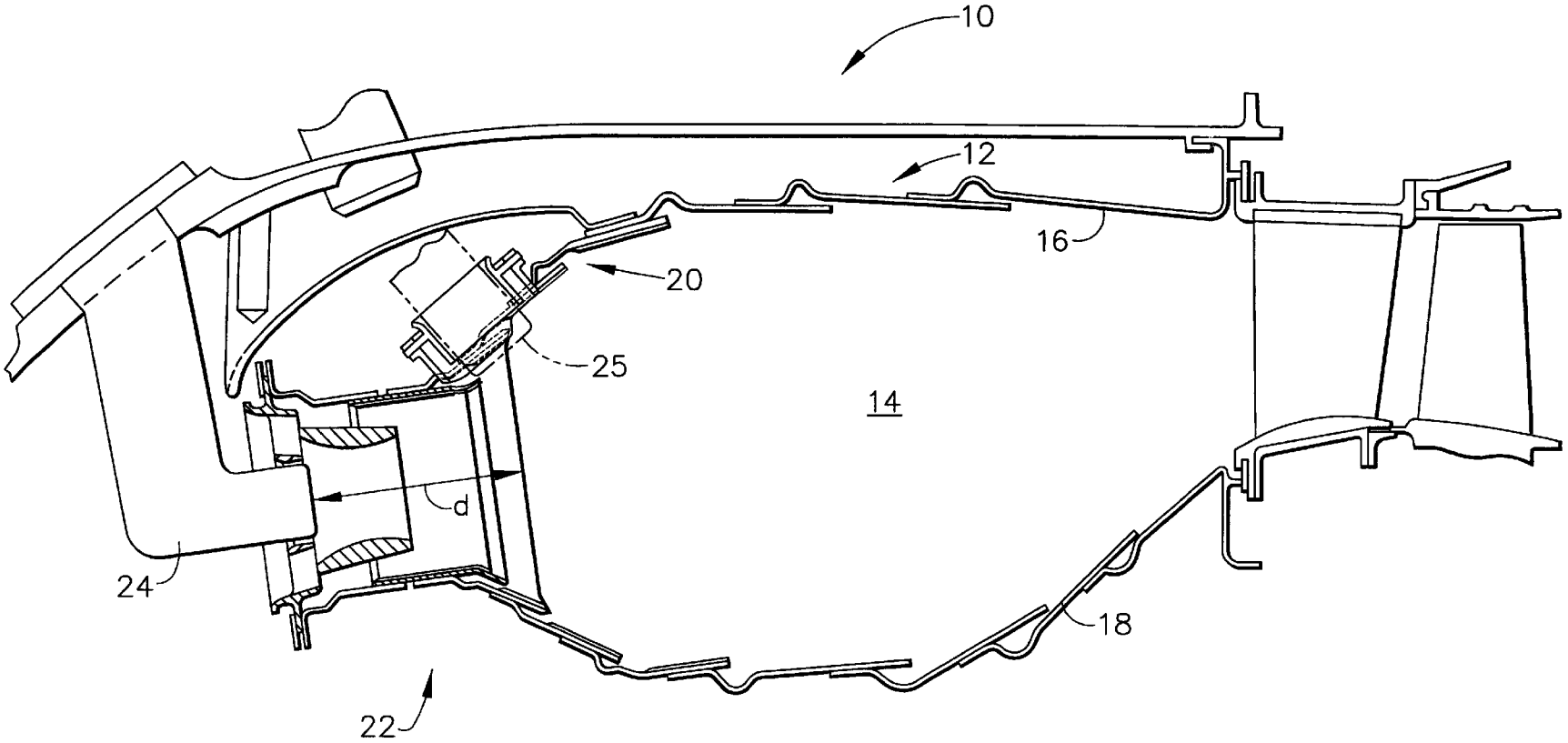
FIG. 1 is a partial cross-sectional view through a single annular combustor structure in accordance with the present invention.

Referring now to the drawings in detail, wherein identical numerals indicate the same elements throughout the figures, FIG. 1 depicts a cross-sectional view of a continuous burning combustion apparatus 10 of the type suitable for use in a gas turbine engine and comprises a hollow body 12 which defines a combustion chamber 14 therein. Hollow body 12 is generally annular in form and is comprised of an outer liner 16, an inner liner 18, and a domed end or dome 20. It should be understood, however, that this invention is not limited to such an annular configuration and may well be employed with equal effectiveness in combustion apparatus of the well known cylindrical can or cannular type. In the present annular configuration, domed end 20 of hollow body 12 includes a swirl cup package 22, where certain components of combustor 10 are prepared in accordance with a patent application entitled "Method Of Protecting Gas Turbine Combustor Components Against Water Erosion And Hot Corrosion," having Ser. No. 09/070,053 and being filed on Apr. 30, 1998, so as to allow the injection of water into combustion chamber 14 without causing thermal stress and water erosion thereto.

FIG. 1 also depicts a fuel nozzle 24 inserted into swirl cup package 22. Fuel nozzle 24 preferably is a dual cone fuel nozzle, whereby both fuel and water may be provided to combustion chamber 14. In this way, fuel may be ignited by an igniter 25 positioned adjacent an upstream end of combustion chamber 14 while water reduces the temperature, and consequently, emissions therein. It will be noted in FIG. 1 that fuel nozzle 24 may be spaced a distance d from combustion chamber 14 in order to prevent carbon clusters from forming on the tip surfaces of nozzle 24 resulting from close proximity to combustion chamber 14.

Figure 2:
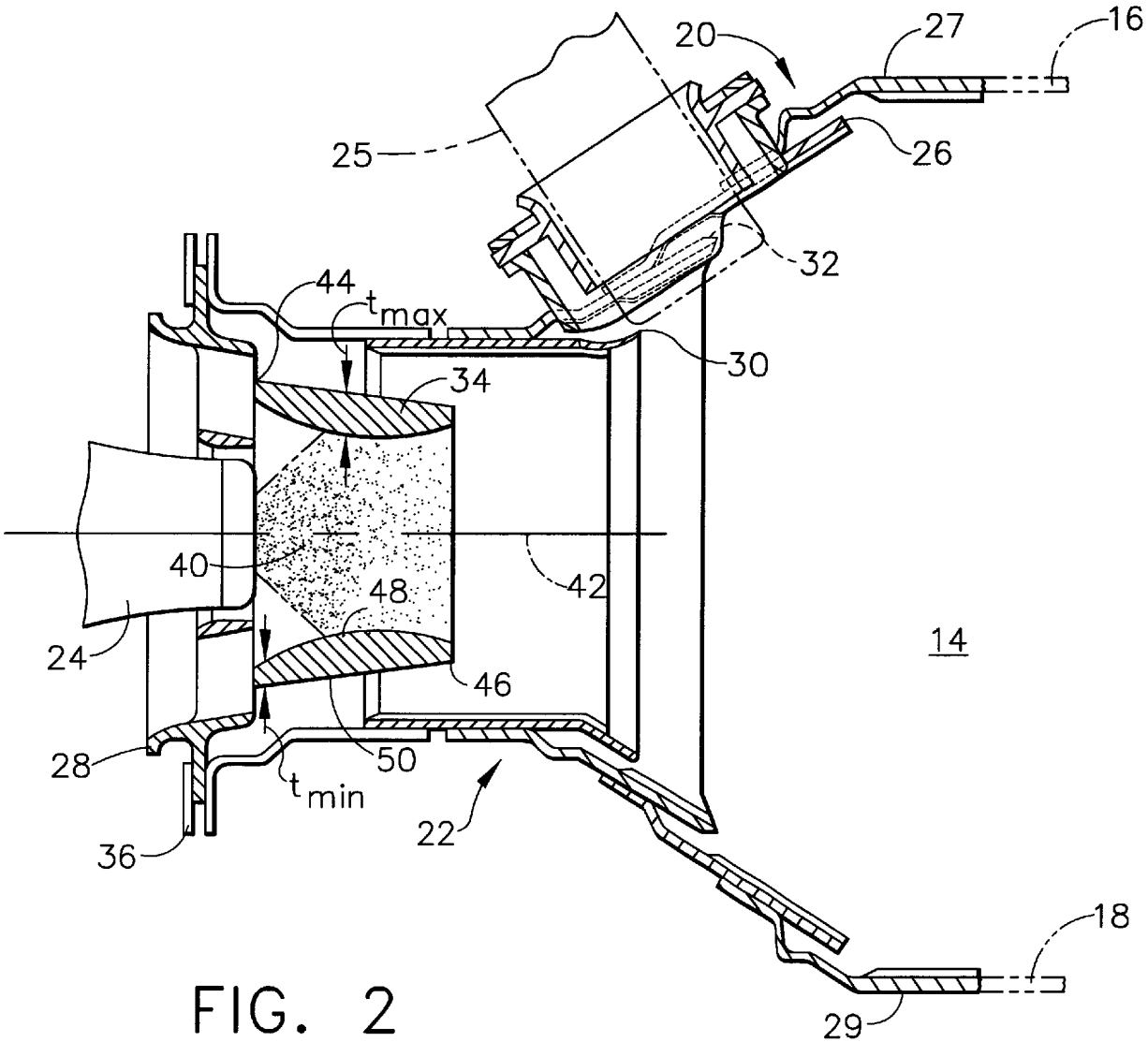
FIG. 2 is an enlarged, partial cross-sectional view of the swirl cup package and combustor dome portion depicted in FIG. 1.

As best seen in FIG. 2, combustor dome 20 consists of a single spectacle plate 26, which is generally a die formed sheet metal part. Outer and inner rivet bands 27 and 29, respectively, are provided to connect spectacle plate 26 to outer liner 16 and inner liner 18. An individual swirl cup package 22 is brazed into spectacle plate 26 and includes therein a swirler 28, a swirl cup 30, a splash plate (or trumpet) 32, and a venturi 34. Swirl cup assembly 22 preferably is brazed together with a retainer 36 welded into position on the front surface of swirler 28.

FIG. 2 also illustrates the injection of water and fuel into venturi 34, whereupon it is caused to swirl in a frusto-conical manner 40 by air flow through the inner portion of swirler 28. Contrary to the water injected in the '053 application, the cone emanating from fuel nozzle 24 impinges on venturi 34 of the present design at an upstream portion thereof in a position similar to that shown for the venturi in the '786 patent. Accordingly, the need for a heat shield or other coating at the downstream portion of venturi 34 is not necessary for the present application.

While the '786 patent discloses the use of a heat shield at the upstream end of its venturi to protect against thermal gradients produced by impingement of relatively cool water (i.e., less than 200° Fahrenheit) at an inner surface and relatively hot air (i.e., approximately 800–1000° Fahrenheit) at an outer surface thereof, it has been found that such design merely causes the thermal gradients to be experienced downstream of the heat shield. In this way, the heat transfer conduction path becomes shortened and actually causes axial stresses on the venturi to move downstream instead of being reduced. Even though the '786 patent utilizes an extended venturi design, which serves to lengthen the heat transfer conduction path, problems in lighting-off liquid fuel have been experienced due to the proximity of the igniter to the downstream end of such extended venturi.

In order to solve the problems associated with the aforementioned venturi designs, the present invention employs a short, thick venturi 34 like that depicted in the '053 application which preferably has an axial length about halfway between swirler 28 and combustion chamber 14. Rather than include a heat shield at an upstream portion thereof like the '786 patent, however, venturi 34 is configured to have a specified thickness t from an upstream end 44 to a downstream end 46 which provides a heat transfer conduction path that reduces axial stresses imposed thereon by the difference in temperature between the fuel/water impinging on an inner surface 48 at an upstream portion of venturi 34 and the air flowing along an outer surface 50 thereof. It will be appreciated, however, that thickness t of venturi 34 is preferably not consistent or uniform across the axial length thereof. More specifically, the maximum thickness $t_{max}$, located at about the midpoint of venturi 34, has a range of approximately 0.150–0.180 of an inch. The minimum thickness $t_{min}$ is located at upstream and downstream ends 44 and 46, respectively, and ranges from approximately 0.05–0.07 of an inch.

By configuring venturi 34 in this way, axial stresses incurred thereby are able to be maintained below a 0.2% yield strength of the material utilized therefor. Typically, swirler 28 and venturi 34 are made of a cobalt-based alloy material having good wear characteristics, such as one known in the industry by the designation L605. Further, the thermal gradient across thickness t of venturi 34 is preferably maintained at approximately 620–650 degrees Fahrenheit per inch at an axial stress of approximately 40–60 thousand pounds per square inch (ksi).

Figure 3:
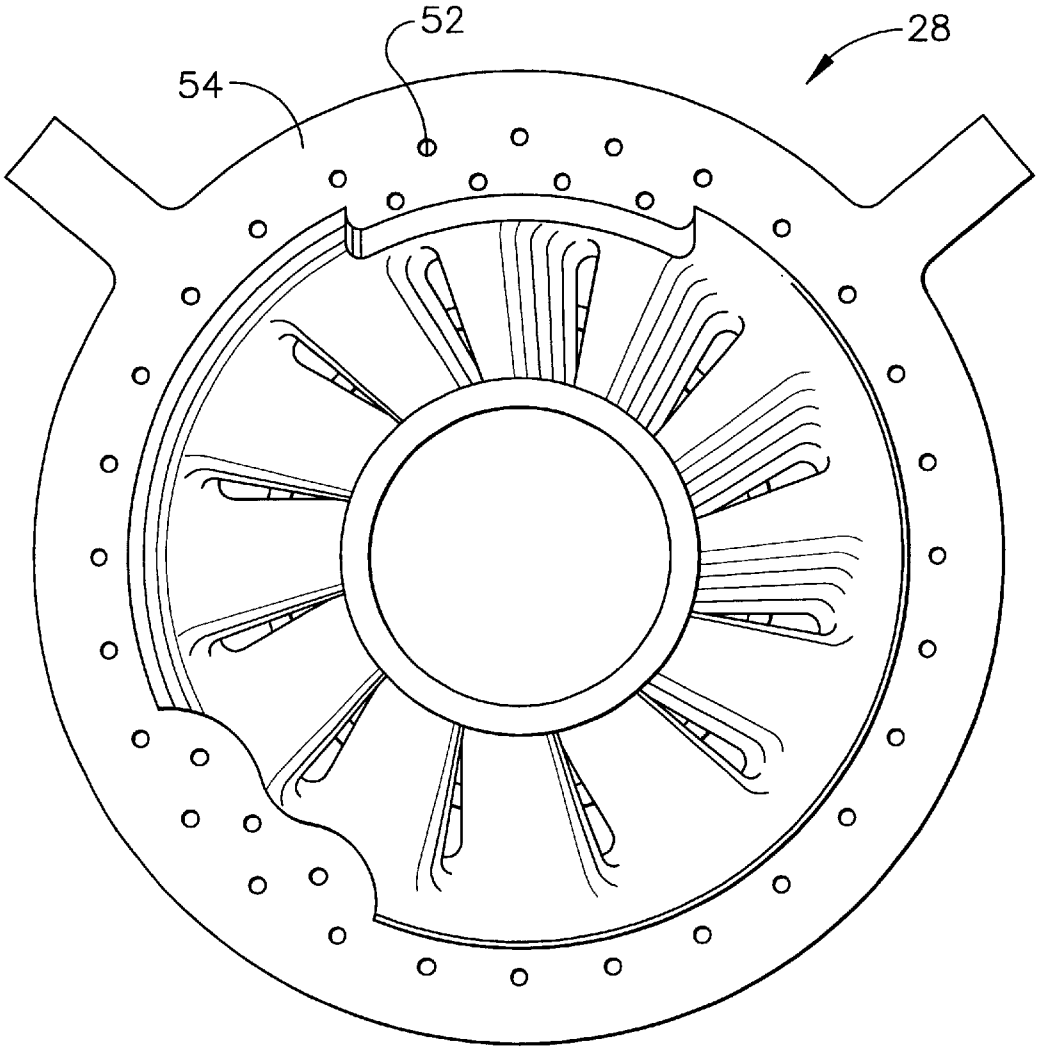
FIG. 3 is a front view of the swirler depicted in FIGS. 1 and 2.

By eliminating the heat shield provided for the venturi in the Campbell patent, it is preferred that swirler 28 and venturi 34 of the present invention be casted in a single piece, where swirler 28 has a plurality of purge holes 52 cast in a face plate portion 54 thereof (see FIG. 3). It will be appreciated that purge holes 52 provide the air about outer surface 50 of venturi 34.

It will further be appreciated that because the geometry of venturi inner surface 46 has a radius and the axial length thereof are consistent with the venturi used for so-called "dry" conditions (i.e., where water is not injected into combustion apparatus 10), swirl cup 22 may be utilized for both wet and dry applications. This increases the flexibility of the design and thereby reduces the overall cost involved.

In operation, compressed air from a compressor (not shown) is injected into the upstream end of swirl cup package 22 where it passes through swirler 28 and enters venturi 34. Fuel and water are injected into venturi 34 via fuel nozzle 24. At the upstream end of swirl cup package 22, fuel/water mixture 40 is supplied into a mixing region in venturi 34 and then to combustor chamber 14 which is bounded by inner and outer liners 18 and 16. Fuel/water mixture 40 is then mixed with recirculating hot burnt gases in combustion chamber 14. In light of the improvements made to venturi 34 of combustor 10 described herein, however, the concerns of axial stresses thereon caused by thermal gradients and consistent light-off of liquid fuel are met.

What it claimed is:

1. A combustion apparatus for a gas turbine engine, comprising:

(a) a combustor structure including at least one combustion chamber;

(b) a dual cone fuel nozzle for injecting both fuel and water to said combustion chamber; and (c) a swirl cup package upstream of and adjacent to said combustion chamber, said swirl cup package further comprising:

(1) a swirler; and (2) a venturi extending between said nozzle and said combustion chamber for mixing said and water with air;

wherein said venturi is configured without a heat shield along an inner surface thereof and has a varying thickness from an upstream end to a downstream end resulting in a heat transfer conduction path that reduces axial stresses imposed on said venturi when water impinges on an upstream portion of said venturi.

2. A combustion apparatus for a gas turbine engine, comprising:

(a) a combustor structure including at least one combustion chamber;

(b) a dual cone fuel nozzle for injecting both fuel and water to said combustion chamber; and (c) a swirl cup package upstream of and adjacent to said combustion chamber, said swirl cup package further comprising:

(1) a swirler; and (2) a venturi extending between said nozzle and said combustion chamber for mixture said fuel and water with air;

wherein said venturi is configured to have a thickness from an upstream end to a downstream end resulting in a heat transfer conduction path which maintains axial stresses imposed on said venturi below a 0.2% yield strength of the material utilized for said venturi when water impinges on a upstream portion of said venturi.

3. A combustion apparatus for a gas turbine engine, comprising:

(a) a combustor structure including at least one combustion chamber;

(b) a dual cone fuel nozzle for injecting both fuel and water to said combustion chamber; and (c) a swirl cup package upstream of and adjacent to said combustion chamber, said swirl cup package further comprising:

(1) a swirler; and (2) a venturi extending between said nozzle and said combustion chamber for mixing said fuel and water with air, said venturi being configured to have a thickness from an upstream end to a downstream end resulting in a heat transfer conduction path which reduces axial stresses imposed on said venturi when water impinges on an upstream portion of said venturi;

wherein a thermal gradient across said venturi thickness is maintained at approximately 620–650 degrees Fahrenheit per inch for an axial stress in a range of 40–60 thousand pounds per square inch.

4. The combustion apparatus of claim 1, wherein said swirler and said venturi are cast as a single piece.

5. The combustion apparatus of claim 1, wherein a maximum thickness of said venturi is in a range of approximately 0.150–0.180 of an inch.

6. The combustion apparatus of claim 1, wherein a minimum thickness of said venturi is in a range of approximately 0.05–0.07 of an inch.

7. The combustion apparatus of claim 1, wherein said venturi is configured so that said combustion apparatus is operable without water injection.

8. The combustion apparatus of claim 4, said swirler having a plurality of purge holes cast in a face plate portion thereof.

9. The combustion apparatus of claim 1, further comprising an igniter positioned adjacent an upstream end of said combustion chamber.

10. The combustion apparatus of claim 1, said swirl cup package further comprising a swirl cup and a splashplate.

11. The combustion apparatus of claim 1, said venturi having an axial length extending from said swirler to approximately half the distance to said combustion chamber.

12. The combustion apparatus of claim 2, said venturi having a varying thickness from said upstream end to said downstream end.

13. The combustion apparatus of claim 2, said venturi having an axial length extending from said swirler to approximately half the distance to said combustion chamber.

14. The combustion apparatus of claim 2, said venturi being configured without a heat shield along an inner surface thereof.

15. The combustion apparatus of claim 3, said venturi having a varying thickness from said upstream end to sad downstream end.

16. The combustion apparatus of claim 3, said venturi having an axial length extending from said swirler to approximately half the distance to said combustion chamber.

17. The combustion apparatus of claim 3, said venturi being configured without a heat shield along an inner surface thereof.

* * * * *